United States Patent [19]

Robbins et al.

[11] Patent Number: 5,046,959

[45] Date of Patent: Sep. 10, 1991

[54] CONNECTOR ASSEMBLY

[75] Inventors: Dan E. Robbins, Glendale; Charles G. Kozlowski, Cave Creek; Archie L. Epperson, Phoenix, all of Ariz.

[73] Assignee: Honeywell, Inc., Minneapolis, Minn.

[21] Appl. No.: 607,944

[22] Filed: Nov. 1, 1990

[51] Int. Cl.[5] ..... H01R 4/66

[52] U.S. Cl. ..... 439/92; 29/842

[58] Field of Search ..... 439/92, 95, 108, 607, 439/888, 456; 29/842, 857

[56] References Cited

U.S. PATENT DOCUMENTS

| | | | |
|---|---|---|---|
| 4,806,110 | 2/1989 | Lindeman | 439/108 |
| 4,906,199 | 3/1990 | Twomey et al. | 439/95 |
| 4,975,084 | 12/1990 | Fedder et al. | 439/108 X |

*Primary Examiner*—Eugene F. Desmond

*Attorney, Agent, or Firm*—Howard Paul Terry

[57] ABSTRACT

A connector assembly having a signal post receptacle subassembly and a ground post receptacle subassembly. The signal post receptacle assembly has a connector shell which is mounted on an electrical assembly chassis, and has an electrical insulation board which is supported by the connector shell, and has a group of signal posts extending through and supported by the electrical insulation board, and having a retainer plate assembly fixedly attaching the electrical insulation board to the connector shell. The ground post receptacle subassembly has a ground post plate mounted on the retainer plate assembly, and has a group of ground posts with each ground post being fixedly connected at one end thereof to the ground post plate. An electrical grounding path extends from each ground post, through the ground post plate, retainer plate assembly, and connector shell, to the electrical assembly chassis.

5 Claims, 3 Drawing Sheets

CONNECTOR ASSEMBLY

The invention relates to a connector assembly, and in particular the invention relates to a connector assembly having wire wrap signal posts and having wire wrap ground posts.

BACKGROUND OF THE INVENTION

The prior art connector assembly is described in the publication entitled "Standard Line Connector Catalog-86/87 Edition" published by ITT Cannon, 10550 Talbert Avenue, P.O. Box 8040, Fountain Valley, Calif. 92728-8040, U.S.A.

The prior art connector assembly includes a connector shell, retainer plate assembly, and a signal post receptacle subassembly which has a plurality of signal posts for connection to respective signal wires of conductors.

One problem with the prior art connector assembly is that it is necessary to solder corresponding ground wires of the conductors to solder lugs which are attached via mounting screws to the retainer plate assembly.

SUMMARY OF THE INVENTION

According to the present invention, a connector assembly is provided. This connector assembly includes a connector shell, a retainer plate assembly, a signal post receptacle subassembly, and a ground post receptacle subassembly.

By using the ground post receptacle subassembly, the necessity of soldering ground wires to solder lugs is elimated.

The foregoing and other objects, features and advantages will be apparent from the following description of the preferred embodiment of the invention as illustrated in the accompanying drawings.

DESCRIPTION OF THE PREFERRED EMBODIMENT

Figure 1:
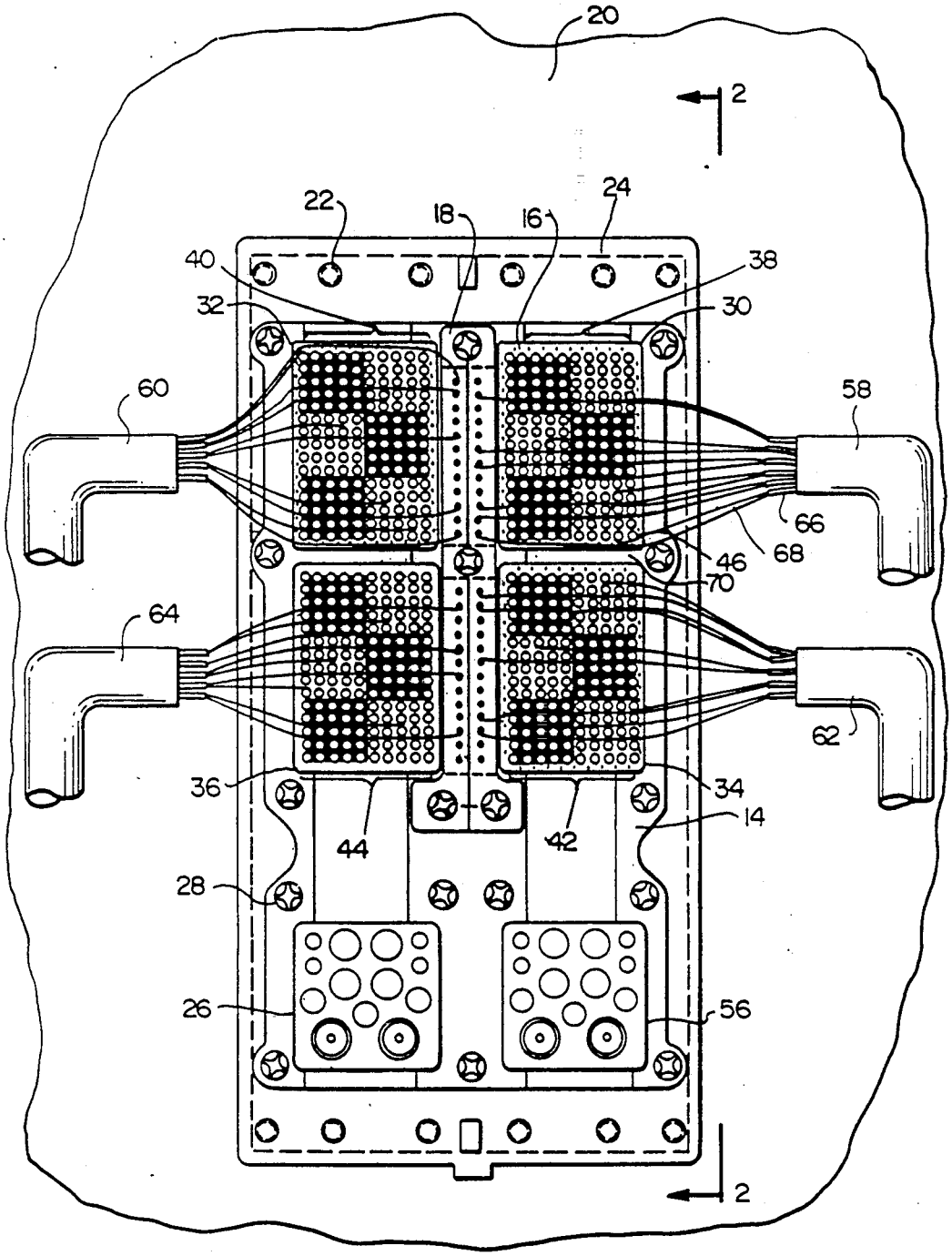
FIG. 1 is an elevation view of a connector assembly according to the present invention.
Figure 2:
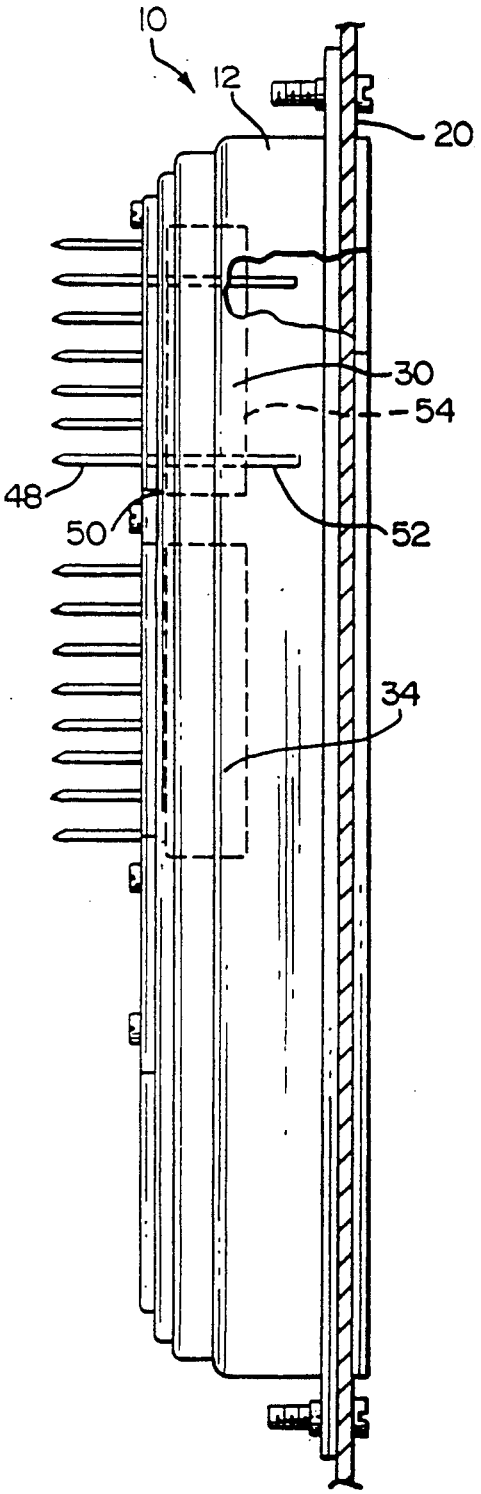
FIG. 2 is a section view as taken along the line 2—2 of FIG. 1.

As shown in FIGS. 1 and 2, a connector assembly 10 is provided. Connector assembly 10 includes a connector shell 12, a retainer plate assembly 14, a signal pin or post receptacle subassembly 16, and a ground pin or post receptacle subassembly 18. Connector shell 12 is attached to a computer chassis or support 20 by a plurality of screws 22. Chassis 20 has a cutout 24 for the connector shell flange.

Signal post receptacle subassembly 16 has a retainer plate assembly(s) 14 which is fixedly connected by a plurality of screws 28 to connector shell 12. Subassembly 16 also has four electrical insulation boards 30, 32, 34, 36, which are supported by connector shell 12. Electrical insulation boards 30, 32, 34 and 36 are positioned and retained by connector shell 12 and retainer plate assembly 14, respectively. Subassembly 16 also has four sets or groups of wire wrap signal post 38, 40, 42, 44.

Each signal post group 38 or 40 or 40 or 42 or 44 can be populated to a maximum of one hundred fifty wire wrap signal posts, which are arranged in fifteen rows of ten posts per row.

As shown in FIGS. 1 and 2, a typical signal post 46 is identical to all the other signal posts within electrical insulation boards 30, 32, 34 and 36. Typical signal post 46 extends through and is supported by its board 30. Typical signal post 46 has a first end portion 48, which is disposed adjacent to a first face or side 50 or board 30, and has a second end portion 52, which is disposed adjacent to a second face or side 54 of board 30. End 48 is configured as a .025 inch square wire wrap pin whereas end 52 may be configured as a cylindrical male pin or a female receptacle.

Space 26 and 56 identify two additional electrical pin insulator boards that typically utilize larger gauge pins or sockets that do not have wire wrap pin tails as do the pins in boards 30, 32, 34 and 36. However, space 26 and 56 can be populated with boards identical in function to 30, 32, 34 and 36.

In this embodiment, connector assembly 10 is connected to four harnesses 58, 60, 62, 64. A typical conductor 66 is identical to the other conductors. Typical conductor 66 has a signal wire 68, which is connected to signal post 46, and has a ground wire 70, which is connected to ground post subassembly 18. Also, any other conductor requiring a ground termination can be connected to ground post subassembly 18.

Figure 3:
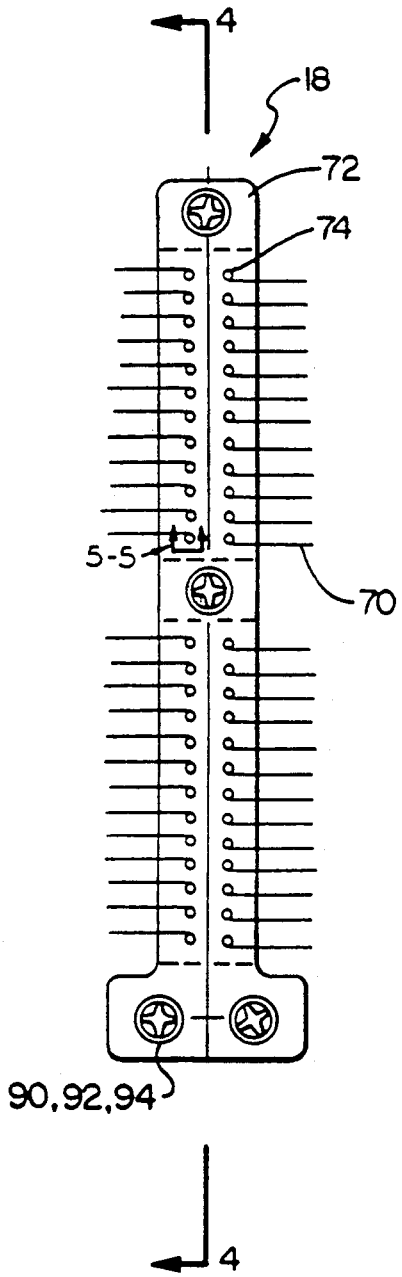
FIG. 3 is an enlarged view of a portion of FIG. 1.
Figure 4:
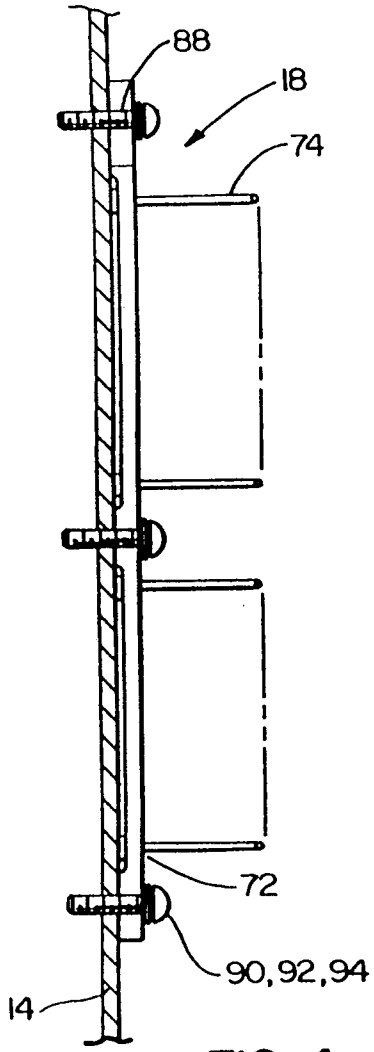
FIG. 4 is a section view as taken along the line 4—4 of FIG. 3.

As shown in FIGS. 3 and 4, ground post receptacle subassembly 18 includes a ground post plate 72, and includes a total of fifty ground posts 74. Each ground post in this embodiment is horizontally aligned with a respective row of ten signal posts.

Figure 5:
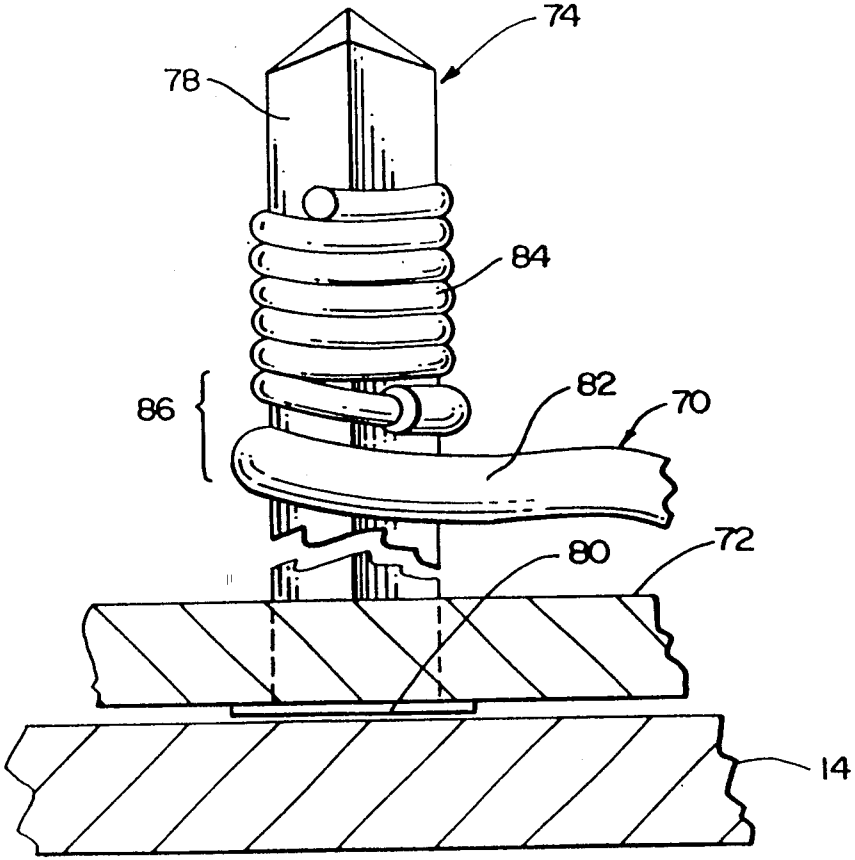
FIG. 5 is a section view as taken along the line 5—5 of FIG. 3.

As shown in FIG. 5, a typical ground post 74 is provided, which is identical to the other ground posts. Post 74 has a cantilever end portion 78 and a base end portion 80. Base portion 80 is press fit into a hole in ground post plate 72. Ground wire 70 has an insulated portion 82 and a bare portion 84. Ground wire 70 also has a region 86 of strain relief. Ground post plate 72 has four mounting holes 88. Retainer plate assembly has respective screws 90, flat washers 92, and lock washers 94, that secure ground post plate 72 to connector shell 12.

Typical ground post 74 has an electrical grounding path through plate 72, plate 14, connector shell 12, to chassis 20. All such parts are made of metal, such as aluminum, steel, or beryllium-copper. Typical signal post 46 is electrically insulated by board 30, which prevents an electrical grounding or shorting thereof.

The method of making connector assembly 10 is indicated hereafter. A connector shell 12, that supports an electrically insulating board 30 and retainer plate assembly 14 is formed. Then, a plurality of signal posts are formed. Each signal post 46, which has end portions 48, and 52, is passed through and fixedly connected to the insulating board 30. Then, a plurality of ground posts are formed. Each ground post 74 is fixedly connected at one end thereof to a ground post plate 72, which is then supported on the retainer plate assembly 14. An example of an interconnect is as follows: a signal wire 68 is wrapped at its end around a selective signal post 46. Then, a ground wire 70 is wrapped at its end around a selective ground post 74.

The advantages of connector assembly 10 are indicated hereafter.

(A) Ground post receptacle subassembly 18 provides a standard termination for the typical ground wires 70.

(B) Reliability of the termination of the ground wire 70 is improved by eliminating unsupported ground wire terminations.

(C) Soldering operations are avoided, thereby minimizing labor cost, by using the ground post receptacle subassembly 18.

(D) A semi-automatic standard wire wrap machine can be used for connecting the end of the typical ground wire 70.

(E) Harnesses 58, 60, 62, 64 have relatively larger surrounding clear spaces by using connector assembly 10.

(F) The typical ground post 74 and connecting ground wire 70 have a region 86 of strain relief which relatively improves connection reliability.

(G) The overall savings cost of connector assembly 10 relative to the prior art connector assembly is about twenty U.S. dollars per unit.

(H) The lead length of signal wire, which is the length of the signal wire 68 from its separation point from its ground wire 70 to its termination point on its signal post 46, is minimized, thereby minimizing the amount of electrical line noise caused by the lead length, as compared to the lead length of the prior art signal wire with its soldered connection at its solder lug located relatively far from its separation point from its ground wire.

(I) Hand labeling of ground wires, and soldering of ground wires, are eliminated in the process of manufacture of connector assembly 10.

(J) Provides a more reliable electrical assembly ground because the ground pin plate has multiple fasteners.

(K) Results in fewer mis-wires because ground wires are connected by a numerical tape controlled semi-automated wire wrap machine instead of by hand.

While the invention has been described in its preferred embodiment, it is to be understood that the words which have been used are words of description rather than limitation and that changes may be made within the purview of the appended claims without departing from the true scope and spirit of the invention in its broader aspects.

The embodiments of an invention in which an exclusive property or right is claimed are defined as follows:

1. A connector assembly comprising:

a signal post receptacle subassembly;

a ground post receptacle subassembly; and support plate means supporting the signal post receptacle subassembly and supporting the ground post receptacle subassembly; wherein the signal post receptacle subassembly includes:

an electrical insulation board supported by the support plate means;

a plurality of signal posts supported by and extending 10 through the electrical insulation board; and each of the plurality of signal posts having a first upper end portion on which a signal wire can be wrapped and having a second lower end portion;

the first upper end portion being disposed adjacent to a first upper side of the electrical insulation board and the second lower end portion being disposed adjacent to a second lower side of the electrical insulation board, and wherein the ground post receptacle subassembly includes:

a ground post plate mounted on the support plate means;

a plurality of ground posts;

each ground post having a cantilever end portion on which a ground wire can be wrapped and a base end portion; and each base end portion being fixedly connected to the ground post plate; and including at least one wire unit having a signal wire and having a ground wire; wherein the ground wire has an insulated portion and has a bare portion, the bare portion being wrapped around a respective ground post cantilever end portion forming a region of strain relief and forming an electrical conduction path through the ground wire and the ground post.

2. The assembly of claim 1, wherein the support plate means includes a connector shell supporting the electrical insulation board and the ground post plate and includes a chassis connected to the connector shell, the chassis having a cutout for a portion of the connector shell.

3. The assembly of claim 2, wherein the plurality of signal posts are arranged in rows, and wherein each row of signal post is disposed adjacent to and aligned with one of said ground posts.

4. The assembly of claim 3, wherein each signal post has an intermediate portion between its first upper end portion and its second lower end portion, said intermediate portion being fixedly connected to its respective insulation board.

5. A method of making a connector assembly which permits use of an overhead wrap around wiring machine including the steps of:

forming a horizontally disposed electrical insulation board which is mounted on a horizontally disposed connector shell;

forming a plurality of vertically disposed signal post, each signal post having a first upper end portion and a second lower end portion and an intermediate portion disposed between the first end portion and the second end portion;

extending each signal post vertically through the electrical insulation board;

fixedly connecting each intermediate portion to the electrical insulation board;

forming a plurality of vertically disposed ground posts, each ground post having a cantilever upper portion and a base portion;

fixedly connecting each base portion to a ground post plate;

fixedly connecting the ground post plate to the connector shell via a retainer plate assembly;

wrapping a horizontally disposed signal wire around a respective selective signal post; and wrapping a horizontally disposed ground wire around a respective selective ground post.

* * * * *